United States Patent [19]

Brasa

[11] 3,945,317

[45] Mar. 23, 1976

[54] WEB REGISTRATION SYSTEM USING RETROGRADE WEB MOVEMENT

[76] Inventor: Umberto Brasa, Uguccione da Pisa, No. 6, Milan, Milan Province, Italy

[22] Filed: June 28, 1973

[21] Appl. No.: 374,757

[30] Foreign Application Priority Data

June 28, 1972 Italy ..... 26345/72

[52] U.S. Cl. ..... 101/124; 101/115; 101/126; 101/228; 226/143

[51] Int. Cl.[2] ..... B41F 15/24

[58] Field of Search ..... 101/114, 115, 124, 126, 101/129, 228; 226/143

[56] References Cited

UNITED STATES PATENTS

| | | | |
|---|---|---|---|
| 1,936,068 | 11/1933 | Marquardt | 101/228 X |
| 3,198,114 | 8/1965 | Jones et al. | 101/228 |
| 3,548,747 | 12/1970 | D'Amato | 101/228 X |
| 3,559,568 | 2/1971 | Stanley | 101/181 X |
| 3,650,207 | 3/1972 | Black | 101/115 |

*Primary Examiner*—Edgar S. Burr
*Assistant Examiner*—R. E. Suter
*Attorney, Agent, or Firm*—Silverman & Cass

[57] ABSTRACT

Automatic registration of the web of sheet material on a printing cylinder is effected in a silk screen printing apparatus which includes a printing frame reciprocably movable in an impressing and return cycle. A printing cylinder is arranged for carrying a web of sheet material in impression receiving relation to said printing frame during the impression-forming portion of its movement. Web guide rollers are arranged to direct the web to and from said printing cylinder. A first drive arrangement, including a first motor, is connected both to drive the printing frame reciprocably and said printing cylinder unidirectionally in the impression-receiving direction. The printing cylinder is disengaged from the first drive during the reverse travel of the printing frame so that the web is stationary. A second drive arrangement is provided, including a second motor, connected to drive the printing cylinder in a second direction, that is the reverse of the printing direction. A photocell is positioned to scan the web downstream of said printing cylinder and is operable upon said second motor to de-energize the same when said printing cylinder has been reversed to a predetermined position of said web. Indicia carried by said web is sensed by said photocell to effect said de-energization.

5 Claims, 3 Drawing Figures

WEB REGISTRATION SYSTEM USING RETROGRADE WEB MOVEMENT

BACKGROUND OF THE INVENTION

This invention relates generally to silk screen printing apparatus of the type used to form serigraphs and more particularly concerns the provision of means for establishing automatic registration of the image receiving paper web on the printing cylinder to enable repeated passes of the same impressions successively to form multicolored serigraphs in proper registration.

The serigraphic art of printing involves the preparation of color separated silk screens carrying images to be applied to paper web or sheet material. A multitone or multicolor original work of art is utilized prepare a series of silk screens each containing one color separated image. All colors are separated to provide one screen for each represented color. Prints are made by impressing the particular colored ink through the screen using suitable application techniques to a continuous web of sheet material, usually paper. A limited number of impressions are serially made. Thereafter, the web carrying the first series of impressions is rewound, the second color separated screen substituted for the first and the second image is applied in registration with the first image until the series is completed. This process is repeated for as many colors as required to provide the multicolor serigraph print.

Considerable difficulty has heretofore been encountered in achievement of color registration in the course of making serigraphic prints. While color registration devices, web guide means, and similar adjustment means are well known in the printing art, particularly related to the high speed printing arts, none have been suitable for use to achieve proper registration in the serigraphic printing art. There are web guide problems, slippage and looping problems, successive rewinding and back tracking contribute to errors in registration in the serial process. Where there is a high speed run, waste is possible until the alignment is corrected. Moreover, the colors are serially successively applied inn a continuous stream process. In the serigraphic art, every print counts and complete rewinding and after a run with one color is required for application of the second color, and on with as many as twenty different colors all requiring complete rewind and proper registration during the next run. Ordinarily the process of serigraphic print making is a hand operated art not conducive to automation. Thus it would be highly advantageous to provide means whereby registration can be achieved automatically in the formation of serigraphic prints.

DESCRIPTION OF PREFERRED EMBODIMENT

Figure 1:
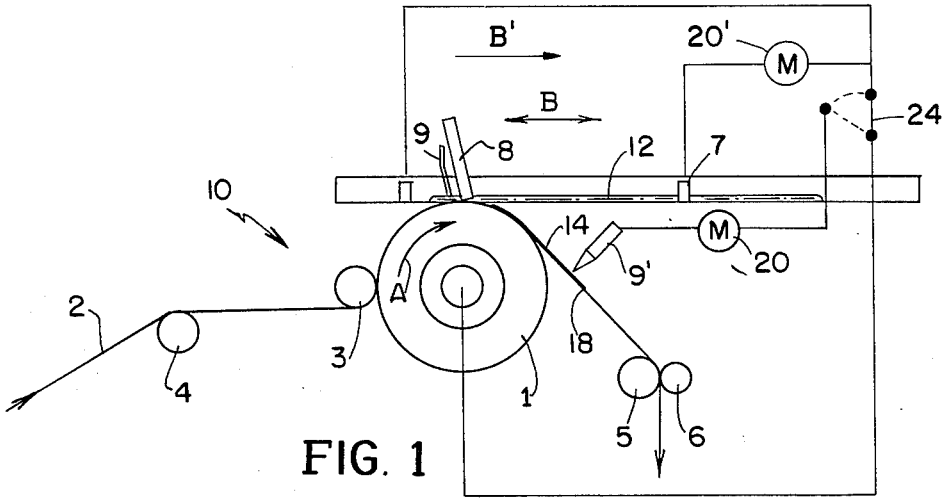
FIG. 1 is a schematic representation of the silk screen printing apparatus illustrating the registration control according to the invention at the immediate post impression stage of the printing process.
Figure 2:
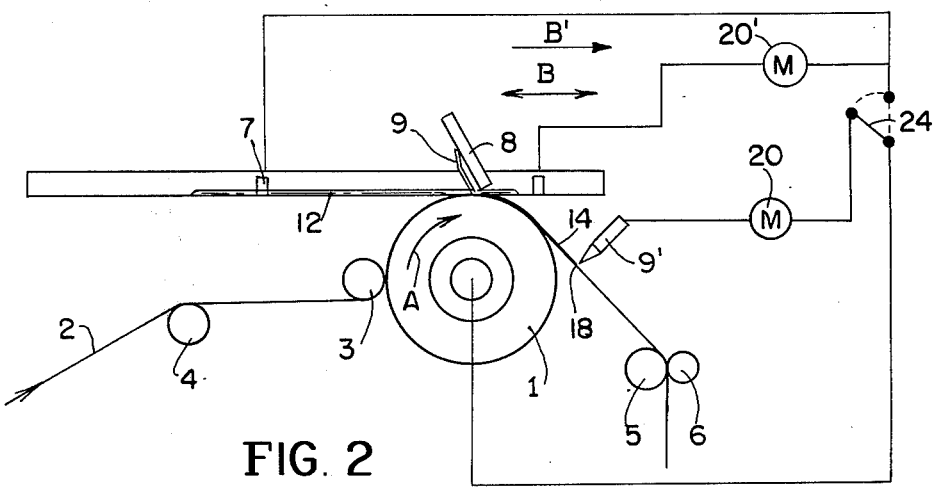
FIG. 2 is a schematic representation of the silk screen printing apparatus shown in FIG. 1 but illustrating the registration control according to the invention at the final or registration stage of the printing operation.
Figure 3:
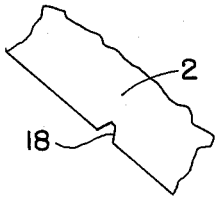
FIG. 3 is a fragmentary detail illustrating the notches formed in the web.

The serigraphic printing apparatus carrying the registration control means according to the invention is designated generally in FIG. 1 by reference character 10. The printing apparatus 10 comprises a printing frame 7 arranged for reciprocating movement alternatingly in the direction represented by the arrows B in the Figures. The printing frame 7 carries a silk screen 12 suitable for color separation printing techniques. The screen 12 is mounted thereon for movement therewith. A suitable ink applicator or spatula 8 is arranged to cooperate with a suitable doctor or scraper 9 so that ink may be applied through the screen to a web of sheet material passing below said screen.

A printing cylinder 1 is provided mounted for driven rotation in one direction indicated by arrow A. Cylinder 1 is positioned proximate the printing frame 7 so that the web 2 is placed in position to receive the impression of the image 14. The web 2 preferably is formed of paper and is unwound from a source roll (not shown) past guide roller 4 and under tensioned roller 3 which holds the web against the printing roller 1. The web 2 is then detached, that is self-detached, from the print cylinder 1 from whence it passes through pressure rollers 5 and 6 to the drying stage (not shown)

A successive series of impressed images 14 are printed upon the continuous length of sheet or web 2. Subsequent to the completion of the series of predetermined number, the first screen 12 is replaced and another color separated screen substituted. The color of ink is changed and the second series of impressed images is intended to be superimposed upon the first images successively with both first and second series in perfect registration.

Clearly, if the web 2 carrying the series of first images is wound on a roller subsequent to the drying stage, and then that last mentioned roller is used as the source roller, the web containing the first images is drawn of said last mentioned roller and passed along the guide train — rollers 4,3,1,5 and 6. Adjustment of the web positioning is required so that the successive images pass in proper registration below the silk screen at the time the impressing is carried out. It is to this purpose that the registration control means of the invention is directed.

The web 2 is provided with a plurality of notches 18 or other readable indicia which are capable of being read by the scanner element 9′ located on the downstream side of the printing cylinder 1. Here the scanner element 9′ takes the form of a photocell. Element 9′ is coupled operatively to slowly reverse the direction of movement of the printing cylinder 1 by energizing a small electric motor 20 connected by known transmission means, including a differential (not shown) to operate the printing cylinder. When the first drive means including motor 20′ which operates the printing frame in the impression direction $B^1$ and unidirectionally operates the printing cylinder in the direction of arrow A is reversed when the impression stage has been completed, the printing frame 7 is translated in the reverse direction. At the same time, the first drive means represented as conventional motor 20′, drivingly coupled to the printing cylinder, is disengaged from said printing cylinder as diagrammatically represented by the operation of switch means 24 or other disabling means well known in the art thus during the return movement of the frame, the said printing cylinder remains stationary. Obviously during the return movement of the frame, conventional means (not shown) are provided to prevent the screen and the ink-applying means 8 and 9 from engaging the web.

When the impression has been applied to the web, the image 14 is positioned with its adjacent registration notch 18 past the scanning element 9'. Now, when the frame 7 moves in the reverse direction . . that is toward its initial condition, the print cylinder does not rotate in the direction of arrow A. Now the small electric motor 20 is energized and takes over the operation of the print cylinder so as to cause the print cylinder to rotate in the direction opposite to the arrow A, that is to back-track. The small motor 20 is de-energized when the scanning element 9' senses the notch 18 and the web and screen are placed properly for the next impression.

On the re-runs, the same notch-scanning element relationship attends and hence, successive runs always have the successive images 14 in proper registration.

What I claim is:

1. Means for automatically registering a paper web on a printing cylinder of a silk screen serigraphic printing machine comprising, means for feeding a web of sheet material to a printing cylinder for receiving a printed impression thereupon and with the web in contact with said cylinder at all times, indicia means carried by said web for indicating proper registration positioning for receipt of the next successive impression thereupon, first drive means including a first drive motor, for rotating said printing cylinder in one direction and thereby advancing said web to a position where said indicia means is located beyond the proper registration position, second drive means including a second drive motor, for rotating said printing cylinder in the opposite direction, retracting said web therewith, means for operatively disengaging said first drive means from said printing cylinder after each impression applied to said web is completed, means operatively engaging said second drive means with said printing cylinder for reversing said printing cylinder carrying the web therewith when said first drive means is disengaged therefrom, said first drive means remaining thus disengaged during operation of said second drive means, and scanning means for sensing said indicia when said web is retracted, said scanning means coupled to said second drive means for operatively disengaging same from said printing cylinder when said indicia reaches the proper registration position, said scanning means being located in monitoring position relative to said web and said indicia means.

2. The structure as claimed in claim 1 in which said indicia comprise notches formed at spaced locations on the web.

3. The structure as claimed in claim 1 in which there is a reciprocable printing frame carrying a silk screen and said first drive means is coupled to drive said printing frame in a first direction to advance said screen in image applying relation to said web simultaneously with operation of said printing cylinder advancing said web for application of an impression to said web by application of selected color ink through said silk screen, said first drive means being operable also to return said printing frame to its initial position when the printing cylinder is disengaged from said first drive means.

4. The structure as claimed in claim 3 in which said scanning means comprises a photocell positioned downstream of said cylinder in sensing relation thereto.

5. The structure as claimed in claim 3 in which said second drive means includes a small electric motor so that the retraction of the web is performed at a speed substantially lower than the speed of advance of the web.

* * * * *